US007726299B2

(12) United States Patent
Reyher

(10) Patent No.: US 7,726,299 B2
(45) Date of Patent: Jun. 1, 2010

(54) FIREPLACE WITH FRONT FACE ATTACHMENT

(75) Inventor: Russell E. Reyher, Winnipeg (CA)

(73) Assignee: R-CO Inc., Winnipeg, Manitoba (CA)

( * ) Notice: Subject to any disclaimer, the term of this patent is extended or adjusted under 35 U.S.C. 154(b) by 182 days.

(21) Appl. No.: 11/012,863

(22) Filed: Dec. 16, 2004

(65) Prior Publication Data

US 2006/0124121 A1 Jun. 15, 2006

(30) Foreign Application Priority Data

Dec. 15, 2004 (CA) ..... 2490288

(51) Int. Cl.
*F24B 1/18* (2006.01)
*F24B 1/192* (2006.01)

(52) U.S. Cl. ..... 126/512; 126/544; 126/547; 126/523

(58) Field of Classification Search ..... 126/544, 126/521, 547, 512, 515, 516, 200, 193
See application file for complete search history.

(56) References Cited

U.S. PATENT DOCUMENTS 4,434,783 A * 3/1984 O'Gorman ..... 126/518
4,601,280 A * 7/1986 Witzel ..... 126/517
5,119,603 A * 6/1992 Jones ..... 52/36.3
5,398,669 A 3/1995 McCullough et al.
5,399,084 A 3/1995 McCullough et al.
5,626,127 A * 5/1997 Maitland et al. ..... 126/523
5,775,408 A * 7/1998 Shimek et al. ..... 165/48.1
5,915,375 A 6/1999 Reyher
5,947,112 A * 9/1999 Hawkinson ..... 126/512
6,050,259 A 4/2000 Reyher
6,736,133 B2 * 5/2004 Bachinski et al. ..... 126/521
2005/0000511 A1 * 1/2005 McDonald ..... 126/523

* cited by examiner

*Primary Examiner*—Kenneth B Rinehart
*Assistant Examiner*—Chuka C Ndubizu
(74) *Attorney, Agent, or Firm*—Adrian D. Battison; Ade & Company Inc.

(57) ABSTRACT

A front face attachment for a fireplace allows a single fireplace construction to be converted from a first arrangement having front facing top outlet and bottom inlet with covering louver panels for air flow around the combustion chamber to a second arrangement in which there are no front facing outlets and the top and bottom outlets are behind front cover flanges for receiving cladding materials.

7 Claims, 4 Drawing Sheets

FIREPLACE WITH FRONT FACE ATTACHMENT

This invention relates to a fireplace with a front face attachment kit which allows the conversion of the fireplace from a type having front louvers for inlet and discharge openings for circulating air which are visible in front elevation to a type where the inlet and discharge openings are not visible in front elevation.

BACKGROUND OF THE INVENTION

Conventional gas fires of the zero-clearance type include an internal combustion chamber where the gas is burned in a combustion assembly which includes elements simulating burning materials to provide an attractive appearance. The combustion chamber includes side walls, top wall, bottom wall and a rear wall.

The combustion chamber is mounted within a housing which separates the combustion chamber from exterior building components so that the housing defines a top wall, a rear wall, a bottom and sides which support the combustion chamber and define heat exchange spaces for the passage of air to maintain the exterior housing cool while the combustion chamber is heated. In most cases this is achieved without the use of insulation materials by providing the required spacing and the required air flow to extract sufficient heat to maintain the exterior housing at the required low temperature.

The combustion chamber may be of the type which draws in combustion air through a duct exterior to the building to be heated and expels the combustion products through another duct also exterior to the building. In some cases these ducts are arranged one inside the other to provide a convenient communication of the airflow and flue gas flow while also acting to transfer heat therebetween. In other cases the combustion air is drawn in from the interior of the building and only the combustion products pass to the exterior of the building for discharge. In yet further cases the arrangement is vent free so that the air for combustion is drawn from the room and the combustion products are returned to the room without any external vents. Where combustion air is drawn from the room, this may enter through a front opening or it may be drawn upwardly through the base of the combustion chamber from the underlying housing portion. The arrangement of the present invention can be utilized with any of these types of construction.

In order to heat the interior of the building, it is common that an air circulating path is arranged around the combustion chamber with air entering at the bottom of the combustion chamber between the bottom of the combustion chamber and the bottom of the housing, and passes along the rear of the combustion chamber and over the top of the combustion chamber to a discharge between the top of the combustion chamber and the top of the housing. In addition some air may be returned along the sides through suitable vent openings. This arrangement is particularly effective in extracting the heat from the combustion chamber and transferring it into the interior of the building.

Commonly the opening at the bottom of the housing underneath the combustion chamber is covered by a vertical panel defining a series of louver openings allowing the air to enter into the opening while providing an attractive appearance. Similarly the top opening above the combustion chamber is also covered by a panel defining louver openings for the passage of the discharge air.

The front of the combustion chamber is closed by a transparent panel in the direct vent type where combustion air is drawn from the exterior through a suitable exterior vent into a closed combustion chamber. However the front may be open in the vent-free type where air is drawn into and discharged from the combustion chamber into the room. In the vented type where combustion air is drawn from the room but vented to the exterior, the front is generally closed by a transparent cover panel but it does not have to be.

These arrangements are commonly used and the air exchange path which passes from the bottom up the rear and over the top has been very successful since it optimizes the airflow system and provides the best transfer of heat from the combustion chamber to the room to be heated.

There is however a desire to provide an arrangement of fire place which omits the louver openings and thus allows only the open front face of the combustion chamber to be visible at the front of the fireplace. This is considered in some cases to be more attractive since there are no visible louver panels and only the combustion chamber with the attractive burning combustion system is visible at the front face.

In U.S. Pat. No. 5,626,127 there is disclosed an arrangement of this type. This provides on the front face of the housing a surrounding panel defining a top panel portion above the combustion chamber and a bottom panel portion below the combustion chamber. These can be covered by decorative materials so that the only part of the fire place visible is the combustion chamber itself.

In this arrangement the recirculating airflow which acts to extract heat from the combustion chamber and transfer it into the room to be heated acts only at the bottom of the combustion chamber so that air is drawn over the top edge of the bottom panel underneath the combustion chamber through central horizontal openings and is discharged through side ones of the horizontal openings. Thus the air enters the area underneath the combustion chamber, turns through a 1800 and passes back out from underneath the combustion chamber.

The present inventor has realized that this arrangement has a number of disadvantages. Firstly the heat exchange system is relatively inefficient since it extracts heat from only underneath the combustion chamber. Secondly this construction is entirely different from the conventional fireplace in that it constitutes an alternative model of fireplace different from the conventional louver type construction. The manufacturer therefore must manufacture this arrangement as a separate model from the conventional louver arrangement and thus the distributor must carry a series of further models thus significantly increasing inventory bearing in mind that each model whether it be of the louver type or the non-louver type comes in a number of different sizes and capacities.

SUMMARY OF THE INVENTION

It is one object of the invention to provide a fireplace which allows a single construction to be used for both louver and non-louver constructions.

According to one aspect of the invention there is provided a combination of a fireplace and a front face attachment therefor comprising:

the fireplace comprising:

a combustion chamber having a bottom wall, a top wall, two side walls and a rear wall;

a gas fuel supply and combustion assembly within the combustion chamber for combustion of a gas fuel to generate heat;

an inlet into the combustion chamber for combustion air;

an outlet from the combustion chamber for combustion products;

a housing for containing the combustion chamber including a bottom wall, a top wall, two side walls and a rear wall with an open front;

the open front defining a bottom opening extending across the housing underneath the combustion chamber for entry into the housing of circulating air;

the open front defining a top opening extending across the housing above the combustion chamber for discharge from the housing of circulating air;

a fan within the housing for driving the circulating air from the bottom inlet opening around the combustion chamber to the top discharge opening for transferring heat from the combustion chamber to the circulating air for expelling heat from the fireplace;

the front face attachment for the fireplace comprising:

a body shaped and arranged to mount on the fireplace in front of the open front of the housing the body having top, bottom and side edges arranged to lie in front of the top wall, bottom wall and side walls of the housing;

the body having a front opening exposing the open front of the combustion chamber;

the body having a first front panel extending in front of the bottom opening in the housing;

the body defining a first opening between a top edge of the first front panel and the open front of the housing to allow air to enter the bottom opening in the housing;

the body having a second front panel extending in front of the top opening in the housing; and the body defining a second opening between a bottom edge of the second front panel and the open front of the housing to allow air to exit from top opening in the housing.

The arrangement defined above may be used with any of the three types of fire place defined above that is the direct vent, vented and vent free. In respect of the direct vent type, the combustion chamber is closed with a transparent cover over a front opening. In the other types it may not be.

Preferably each of the first and second front panels of the attachment is arranged to receive and mount a decorative covering thereon such that in a front elevation the decorative covering covers all parts of the open front apart from the open front of the combustion chamber.

Preferably the attachment includes an inclined baffle extending forwardly and downward from a top of the top opening at the front face of the housing to a bottom edge of the second front panel.

Preferably the attachment includes a horizontal top flange extending rearwardly from a top edge of the second panel to the front face of the housing and wherein the top flange includes a depending attachment portion for mounting the attachment on the front face of the housing.

Preferably the attachment includes a cover plate extending rearwardly of the top edge of the first cover panel for partly covering the first opening to allow passage of air while reducing direct vision therethrough.

Preferably the cover plate has a slot therein extending across its full width.

Preferably the slot is located adjacent the front edge of the cover plate.

Preferably the attachment includes side walls extending between the front opening of the attachment and the open front of the combustion chamber.

BRIEF DESCRIPTION OF THE DRAWINGS

One embodiment of the invention will now be described in conjunction with the accompanying drawings in which.

In the drawings like characters of reference indicate corresponding parts in the different figures.

DETAILED DESCRIPTION

Figure 1:
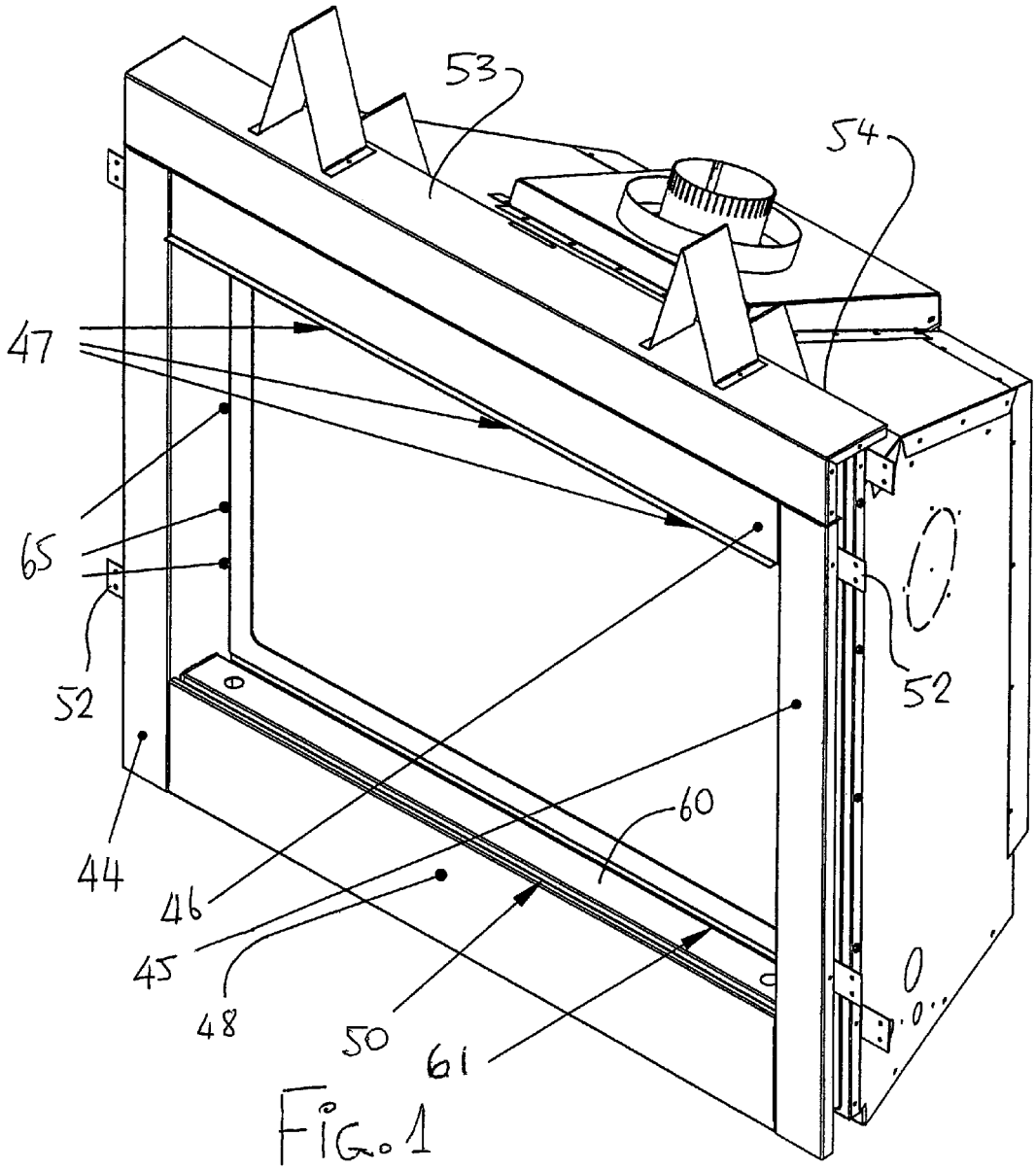
FIG. 1 is an isometric view of a fireplace and attachment according to the present invention wherein the attachment is mounted on the fireplace providing the non-louver appearance.

The basic fireplace assembly generally indicated at 10 includes an interior combustion chamber 11 and an exterior housing 12. These are generally of conventional construction well known to one skilled in the art and further details of fireplaces of this general type are shown in prior U.S. Pat. No. 5,398,669 issued Mar. 21, 1995; U.S. Pat. No. 5,399,084 issued Mar. 21, 1995; U.S. Pat. No. 5,915,375 issued Jun. 29, 1999 and U.S. Pat. No. 6,050,375 issued Apr. 18, 2000 all of the present inventor, the disclosures of which are incorporated herein by reference.

The combustion chamber 11 includes a top wall 12, a bottom wall 13, a rear wall 14 and two side walls 15. These define an open front 16 at which is located a transparent front cover which allows the occupants of the room in which the fireplace is located to view the combustion chamber and the burning materials mounted on a combustion assembly 17 again of conventional type. In the arrangement shown the glass or transparent panel 16 at the open front is flat but other shapes and arrangements can be provided including doors.

The housing 12 includes a top wall 18, a bottom wall 19, a rear wall 20 and two side walls 21. These form an open front 22 with a decorative rib 23 surrounding a central opening 24 which exposes the open front 16 of the combustion chamber.

Above the decorative rib 23 is provided a louver panel 25 covering an opening 26. Below the decorative rib 23 is provided a second louver panel 27 covering an opening 28. A fan 29 draws air through the opening 28 underneath the combustion chamber and drives the air around the back wall of the combustion and over the top wall of the combustion chamber to discharge through the opening 26.

Combustion air enters the combustion chamber through a depth 32 from a coaxial supply duct 33 surrounding a flue duct 34 through which combustion products exit from the combustion chamber through a top opening 35.

All of the above arrangements are conventional and well known to one skilled in the art and may vary in accordance with well known principles.

The attachment for the fireplace is indicated generally at 40 which is arranged to be mounted on the front of the front face of the existing housing 12. This attachment defines a front face 41 which is spaced forwardly from the front face of the existing housing to provide a spacing therebetween. The spacing is filled at the sides by side walls 42 which extend from the front face 41 rearwardly to a rear edge 43 which is located at the front face of the existing housing.

The front face 41 includes side panels 44 and 45 which are relatively narrow so that the edge 43 lies alongside the side edge of the open face 16 of the combustion chamber and the edge side panel 44 projects outwardly therefrom only to the thickness of the conventional housing.

The front face 41 includes a top panel 46 which extends across the top of the side panels 44 and 45 so as to bridge those panels. A bottom edge 47 of the top panel 46 is coincident with the top edge of the combustion chamber so that in front elevation the top panel 46 extends upwardly from the top edge of the combustion chamber and no part of the existing housing is visible below the bottom edge 47.

The bottom of the front face is defined by a bottom panel 48 which extends across the full width of the front face between the side walls 44 and 45 and defines a bottom edge 49 at the bottom of the fireplace and a top edge 50 substantially coincident with the bottom edge of the opening 16 of the combustion chamber. Thus again a front elevation of the fireplace with the attachment provides full view of the combustion chamber but below the combustion chamber is only visible the bottom panel 48.

Sides edges of the front face include mounting tabs 52 by which the front face can be attached to a surround of the building structure.

The top panel 46 includes a horizontal cover panel 53 which extends rearwardly from the front face to a rear edge 54 at which is located a mounting assembly which attaches to a top edge of the existing housing 12 of the conventional fireplace. The mounting assembly can be provided by a simple flange depending from the rear edge 54 onto a receptacle of the fireplace which holds the top edge against front to rear movement together with side tabs which screw onto a suitable receptacle of the fireplace. These are not shown since the specific mounting arrangement can vary within the knowledge of one skilled in this art depending upon the specific construction of fire place with which the attachment is used.

The attachment carries a baffle 56 which has a front edge 57 at the bottom edge of the top panel 46 and extends therefrom upwardly and rearwardly so as to have a rear edge 58 closely adjacent or touching the housing 12 at the top of the opening 26. Thus the baffle 56 is inclined downwardly and forwardly in front of the opening 26 so that air passing out from the opening discharged from the fan 29 impacts on the baffle and is directed downwardly and forwardly to the interior of the room. This baffle therefore acts to guide the air and prevent it from hitting the back of the front panel 46 so that the air is properly directed forwardly rather than merely downwardly in turbulent flow.

The attachment further includes a bottom plate 60 which extends from the top of the bottom panel 48 rearwardly toward the bottom edge of the combustion chamber. The panel 60 is horizontal and extends substantially across the full width of the attachment so as to prevent a person standing in front of the fireplace from viewing downwardly into the area underneath the combustion chamber where the operating components for the fan and for the combustion system are located. The top plate 60 thus forms a baffle but includes one or more slots 61 which allow air to move downwardly through the slot into the area underneath the plate 60 to enter the location underneath the combustion chamber. Thus the plate 60 provides an attractive visual effect which does not detract from the visual appearance of the combustion chamber behind the panel 48 but the plate 60 does not interfere with the entry of air into the system for the recirculating effect. Optional additional air vents 65 can be provided at the sides allow air escape from the recirculation system.

The panels 46 and 48 are arranged to receive attractive covering material such as brick, tile or stone so that the finished fireplace is apparently finished up to the edges of the combustion chamber so that the only material properly visible within the finished edges is the combustion chamber itself.

Figure 2:
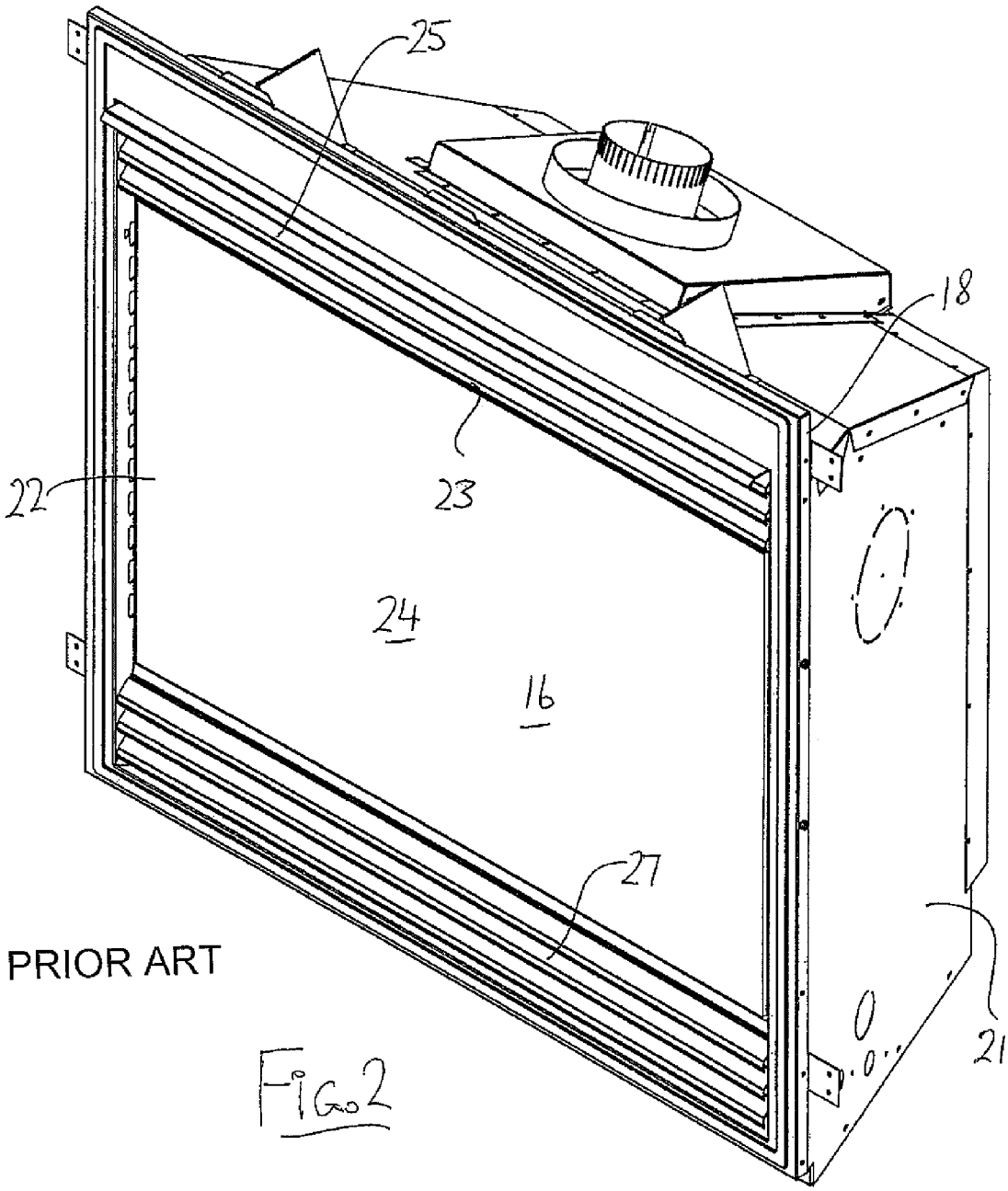
PRIOR ART FIG. 2
FIG. 2 is a similar isometric view of the fireplace of FIG. 1 with the attachment removed and the louver panels inserted into place to provide the louver arrangement of the fireplace.
Figure 3:
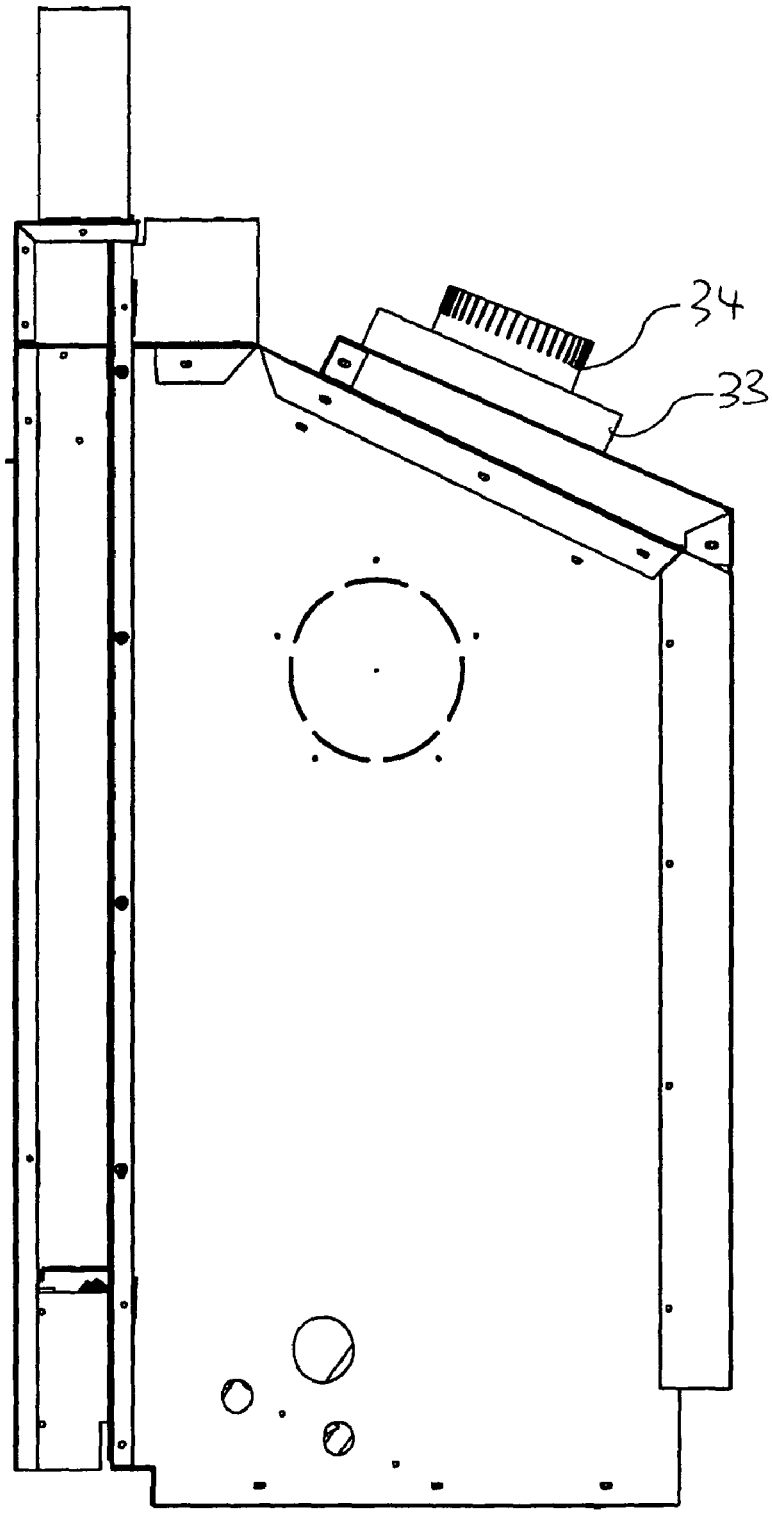
FIG. 3 is a side elevational view of the fireplace of FIG. 1.
Figure 4:
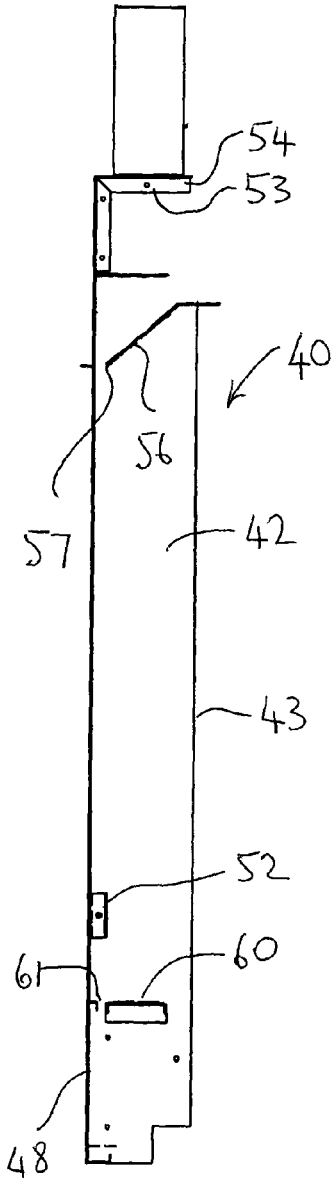
FIG. 4 is a side elevational view of the attachment.
Figure 5:
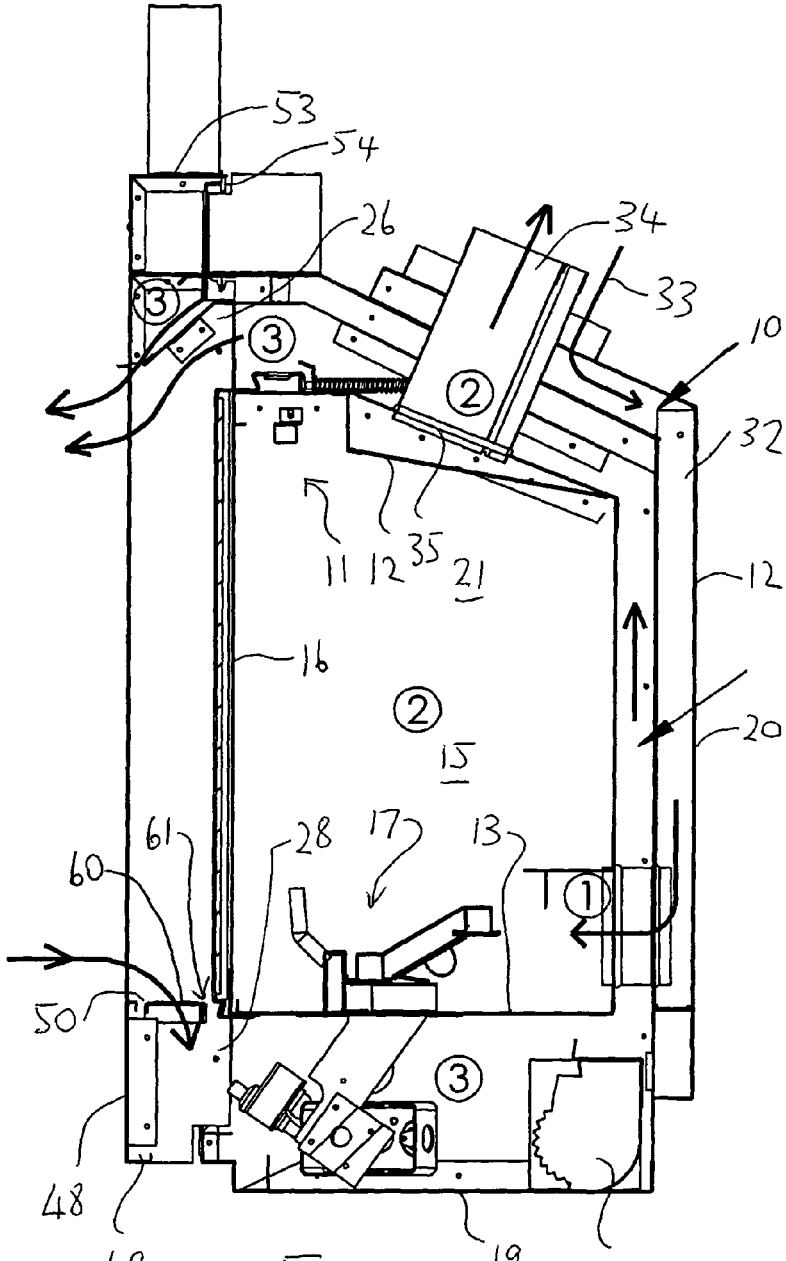
FIG. 5 is a cross sectional view of the fireplace of FIG. 1 including the attachment.

The fireplace construction thus provided allows a single fireplace construction to be used either for the conventional louver arrangement in which the louvers are visible as shown in FIG. 2 above and below the combustion chamber or it can be used with the attachment of FIGS. 1, 4 and 5 in which the finishing of the fireplace surrounding the combustion chamber is brought up to the edges of the combustion chamber so that no louvers are visible.

The fact that the single fireplace can be used either with or without the attachment thus significantly reduces inventory since the attachment itself is relatively small item of limited value in comparison with the relatively high cost of the complete fireplace and its operating components.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A fireplace combination comprising:

a fireplace comprising:

a combustion chamber having a bottom wall, a top wall, two side walls and a rear wall;

a gas fuel supply and combustion assembly within the combustion chamber for combustion of a gas fuel to generate heat;

an inlet into the combustion chamber for combustion air;

an outlet from the combustion chamber for combustion products;

a housing for containing the combustion chamber including a bottom wall, a top wall, two side walls and a rear wall with an open front;

the housing defining a front edge at a front plane of the open front of the housing;

the open front defining a bottom inlet opening in the front plane extending across the housing underneath the combustion chamber and facing forwardly of the open front for entry into the housing of circulating air;

the open front defining a top discharge opening in the front plane extending across the housing above the combustion chamber and facing forwardly of the open front for discharge from the housing of circulating air;

the housing being arranged to allow the circulating air from the bottom inlet opening around the combustion chamber to the top discharge opening for transferring heat from the combustion chamber to the circulating air for expelling heat from the fireplace;

a first removable louver panel shaped and arranged for attachment at the bottom inlet opening in the front plane to provide a cover therefor and arranged so as to allow passage of air therethrough to enter the bottom inlet opening;

a second removable louver panel shaped and arranged for attachment at the top opening in the front plane to provide a cover therefor and arranged so as to allow passage of air therethrough to discharge from the top discharge opening;

the fireplace and the housing and the first and second louver panels being shaped and arranged such that when installed the first and second louver panels lie in the front plane of the housing;

and a removable front face attachment for the fireplace for attachment to the fireplace arranged, with the first and second louver panels removed, to cause the conversion of the fireplace from a fireplace having front louvers for inlet and discharge openings for circulating air which are visible in front elevation to a fireplace where the inlet and discharge openings are not visible in front elevation;

the front face attachment comprising a structure shaped and arranged to mount on the fireplace in front of the front plane of the open front of the housing;

the structure being arranged to lie in front of the top wall, bottom wall and side walls of the housing;

the structure defining a front face which is spaced forwardly from the front plane containing the top and bottom openings of the housing and forwardly from the front edge of the housing to provide a spacing therebetween;

the structure including side walls which extend from the front face of the structure rearwardly to the front edge of the housing;

the structure having a front opening exposing the open front of the combustion chamber;

the structure having a first front panel extending in front of the bottom inlet opening in the housing;

the first front panel being located in front of and spaced forwardly from the bottom inlet opening in the front plane so as to define a first opening rearwardly of a top edge of the first front panel so as to allow air to pass over the top edge and downwardly therefrom to enter the forwardly facing bottom inlet opening in the housing;

the structure having a second front panel extending in front of the top discharge opening in the housing; and the second front panel being located in front of and spaced forwardly from the top discharge opening in the front plane so as to define a second opening rearwardly of a bottom edge of the second front panel so as to allow air to exit from the forwardly facing top opening in the housing to pass downwardly from the top opening and under the bottom edge.

2. The combination according to claim 1 wherein each of the first and second front panels of the attachment is arranged to receive and mount a decorative covering thereon such that in a front elevation the decorative covering covers all parts of the open front apart from the open front of the combustion chamber.

3. The combination according to claim 1 wherein the attachment includes an inclined baffle extending forwardly and downward from a top of the top discharge opening at the front face of the housing to the bottom edge of the second front panel.

4. The combination according to claim 1 wherein the attachment includes a horizontal top flange extending rearwardly from the top edge of the second panel to the front face of the housing and wherein the top flange includes a depending attachment portion for mounting the front face attachment on the open front of the housing.

5. The combination according to claim 1 wherein the front face attachment includes a cover plate extending rearwardly of the top edge of the first cover panel for partly covering the first opening to allow passage of air while reducing direct vision therethrough.

6. The combination according to claim 5 wherein the cover plate has a slot therein extending across its full width.

7. The combination according to claim 6 wherein the slot is located adjacent a front edge of the cover plate.

* * * * *